US007201406B2

(12) United States Patent
Walls et al.

(10) Patent No.: US 7,201,406 B2
(45) Date of Patent: Apr. 10, 2007

(54) ADJUSTABLE HANDLE ASSEMBLY

(75) Inventors: Christopher G. Walls, Rockford, IL (US); Richard L. Green, Rockford, IL (US)

(73) Assignee: Newell Operating Company, Atlanta, GA (US)

( * ) Notice: Subject to any disclaimer, the term of this patent is extended or adjusted under 35 U.S.C. 154(b) by 0 days.

(21) Appl. No.: 10/761,135

(22) Filed: Jan. 20, 2004

(65) Prior Publication Data

US 2004/0183316 A1 Sep. 23, 2004

Related U.S. Application Data

(60) Provisional application No. 60/441,547, filed on Jan. 21, 2003.

(51) Int. Cl.
*E05C 19/10* (2006.01)
*A45C 13/26* (2006.01)

(52) U.S. Cl. ..... 292/100; 292/347; 292/348; 292/352; 292/336.3; 16/413

(58) Field of Classification Search ..... 292/100, 292/347, 348, 352, DIG. 46, 336.3, 350, 292/351, 144; 70/107, 108; 16/413, 414, 16/433, 441
See application file for complete search history.

(56) References Cited

U.S. PATENT DOCUMENTS 201,906 A * 4/1878 Brady ..... 292/351
253,789 A * 2/1882 Towne ..... 292/348
299,633 A * 6/1884 Flinn ..... 292/350
1,442,629 A * 1/1923 Parker ..... 292/347
1,479,026 A * 1/1924 Carmichael ..... 292/348
1,567,954 A * 12/1925 Kalm ..... 292/347
1,707,353 A * 4/1929 Fraser ..... 403/354
1,888,238 A * 11/1932 Moore ..... 292/169
1,888,828 A * 11/1932 Moore ..... 70/216
2,473,937 A * 6/1949 Cameron ..... 292/348
2,644,706 A * 7/1953 McConnell ..... 292/176
3,019,043 A * 1/1962 Woodworth et al. ..... 292/113
3,117,811 A * 1/1964 Duvall ..... 292/113
3,435,644 A * 4/1969 Hines ..... 70/129
3,954,292 A 5/1976 Johnson
4,011,741 A * 3/1977 Nolin ..... 70/107
4,047,408 A * 9/1977 Johns et al. ..... 70/129
4,055,361 A * 10/1977 Moses ..... 292/359
4,109,494 A * 8/1978 Allemann ..... 70/107
4,321,810 A * 3/1982 Wildenradt ..... 70/129
4,453,753 A * 6/1984 Fayerman et al. ..... 292/348
4,502,720 A * 3/1985 Fayerman et al. ..... 292/348
4,671,089 A * 6/1987 Fleming et al. ..... 70/452

(Continued)

*Primary Examiner*—Brian E. Glessner
*Assistant Examiner*—Carlos Lugo
(74) *Attorney, Agent, or Firm*—Banner & Witcoff, Ltd.

(57) ABSTRACT

A device for operating a lock assembly for a door or window assembly has a first configuration when mounted in a right hand door and a second sonfiguration when mounted in a left hand door. The device has a handle having a first position and a second position. A member is operably connected to the handle. The member has structure adapted to cooperate with the lock assembly such that the first position of the handle when the member is adapted to be connected to the lock assembly in the first configuration is the same as the first position of the handle when the member is adapted to be connected to the lock assembly in the second configuration.

24 Claims, 7 Drawing Sheets

U.S. PATENT DOCUMENTS 5,067,758 A * 11/1991 Fann et al. ..... 292/347
5,092,144 A * 3/1992 Fleming et al. ..... 70/95
5,373,716 A * 12/1994 MacNeil et al. ..... 70/109
5,595,409 A * 1/1997 Fier et al. ..... 292/112
5,722,273 A * 3/1998 Lin et al. ..... 70/370
5,906,403 A 5/1999 Bestler et al.
6,676,178 B2 * 1/2004 Budhrani ..... 292/357
6,840,070 B1 * 1/2005 Huang et al. ..... 70/134
2005/0046203 A1 * 3/2005 Huang ..... 292/348

* cited by examiner

ADJUSTABLE HANDLE ASSEMBLY

RELATED APPLICATIONS

This application claims the benefit of U.S. Provisional Application No. 60/441,547, filed Jan. 21, 2003, which application is incorporated herein by reference and made a part hereof.

TECHNICAL FIELD

The present invention relates to a handle assembly for a closure such as a door or window assembly. More specifically, the present invention relates to a handle assembly for a lock mechanism wherein the handle assembly has an adjustable structure such that the handle assembly can be field adjusted and utilized on both right hand doors and left hand doors.

BACKGROUND OF THE INVENTION

Door and window assemblies are commonly known in the art. A door assembly generally has a frame movably supporting a door. The door assembly may further have a lock mechanism supported by the frame and door. The lock mechanism generally includes a lock assembly and a handle assembly. The lock assembly typically includes a housing supporting a lock member such as a hook. The housing has an aperture providing access to the hook. The handle assembly has a handle connected to a rotatable member that is inserted into the aperture of the lock assembly during installation to engage the lock member. Thus, rotation of the handle actuates the lock member via the rotatable member for operation of the lock mechanism.

One problem that exists is that traditional handle assemblies are not adjustable. Thus, when the same handle is installed in the lock mechanism, the position of the handle in the unlocked position is different for a right hand door and a left hand door. For example, in a right hand door, the handle may have a generally vertical configuration in the unlocked position and a generally horizontal configuration in the locked position. If this same handle assembly and lock assembly is installed in a left hand door, however, the handle has an opposite configuration, i.e. a generally horizontal configuration in the unlocked position and a generally vertical configuration in the locked position. These opposite configurations are often considered aesthetically unappealing and thus undesirable. It is preferred that a handle have identical unlocked and locked configurations regardless if the handle is installed in a right hand door or a left hand door.

To solve this problem, the handle assemblies are manufactured to be directionally specific. However, this requires that throughout manufacture, sale and installation, both right hand and left hand handle assemblies are stocked and distributed. This creates increased inventory and cost.

The present invention is provided to solve these and other problems.

SUMMARY OF THE INVENTION

The present invention provides a field adjustable handle assembly for a lock mechanism of a closure such as a door or window assembly. The door assembly includes a frame, a door, and a lock mechanism. The lock mechanism includes a lock assembly and a handle assembly. The lock assembly includes a housing, a lock member or hook, an aperture operably linked to the hook, and a keeper mounted to the door frame.

According to the first aspect of the invention, the handle assembly includes a handle, an adapter, and a member or tailpin. The member has a first position and a second position. The member is cooperatively dimensioned to engage the aperture of the lock assembly. The handle has a first position representing an unlocked position and a second position representing a locked position. The adapter adjustably connects the handle and the member, such that the first position of the handle when the member is in the first position is the same as the first position of the handle when the member is in the second position. The adjustability of the handle assembly of the present invention allows a single handle assembly to be used on either a left handed or right handed door.

Other features and advantages of the invention will be apparent from the following specification taken in conjunction with the following drawings.

DETAILED DESCRIPTION

Figure 1:
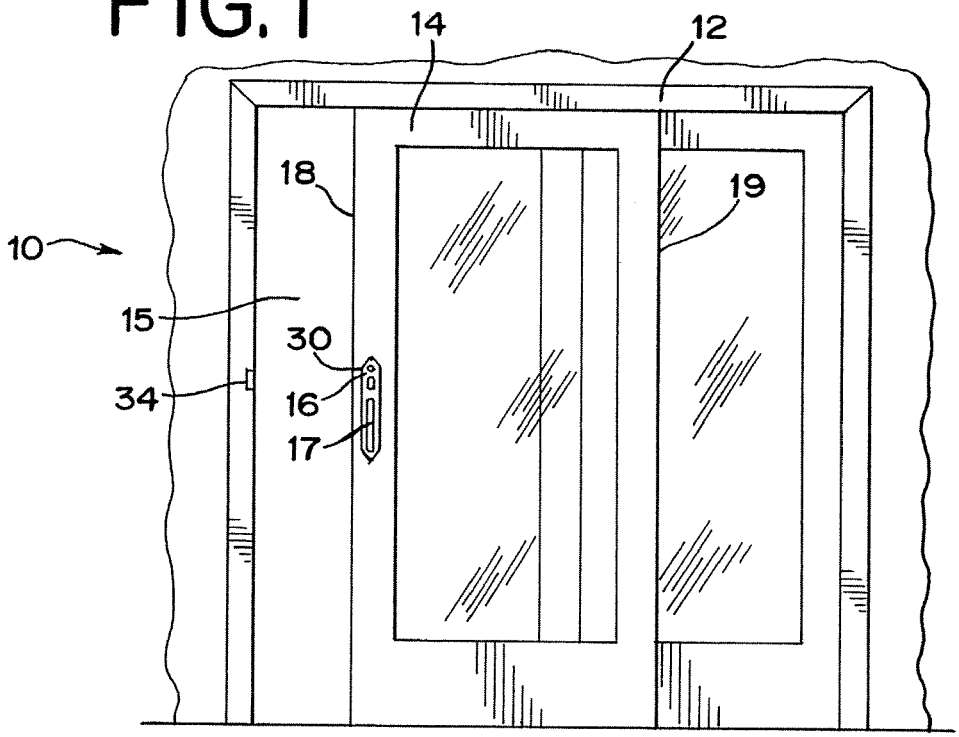
FIG. 1 is a front elevation view of a right hand door assembly.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
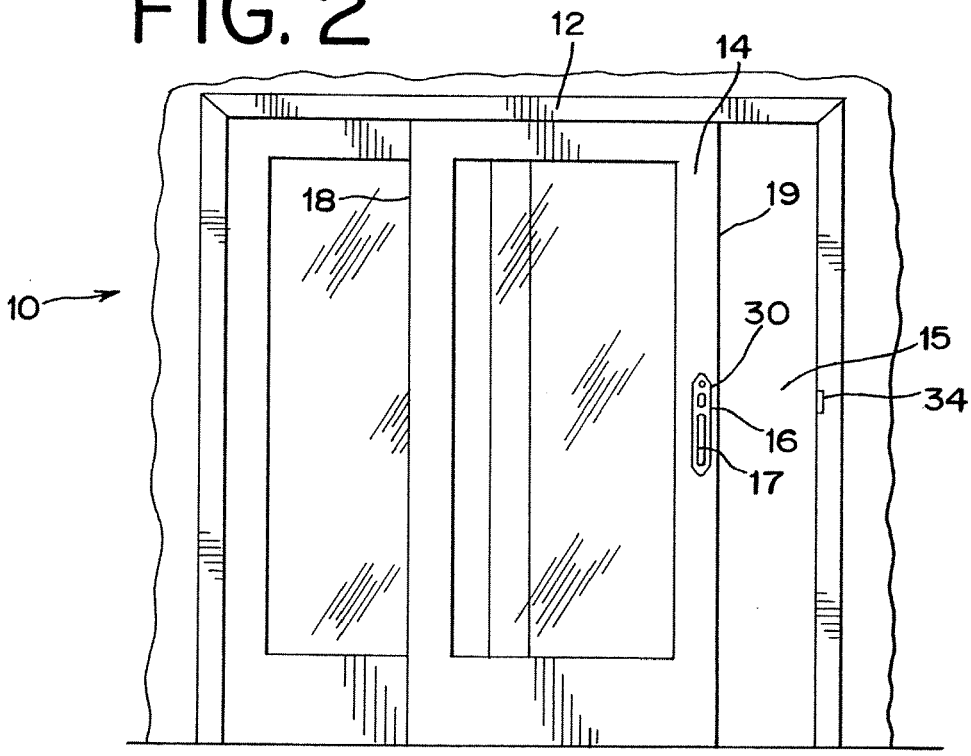
FIG. 2 is a front elevation view of a left hand door assembly.

A door assembly 10 is illustrated in FIGS. 1–2. The door assembly 10 includes a frame 12 and a door 14 slidably mounted in the frame 12. The door 14 includes a left edge 18 and a right edge 19. The door 14 can be slidably moved within the frame 12 between a closed position to an open position. In the closed position, the door 14 abuts the frame 12 such that the door 14 is flush with the frame 12. In the open position, as shown in FIGS. 1–2, the door 14 is slidably moved away from the frame 12 such that an opening 15 occurs between the door 14 and the frame 12. The door 14 includes an escutcheon 16 and a grip 17. The door assembly 10 includes a lock mechanism 20 for securing the door 14 in the closed position.

Figure 2A:
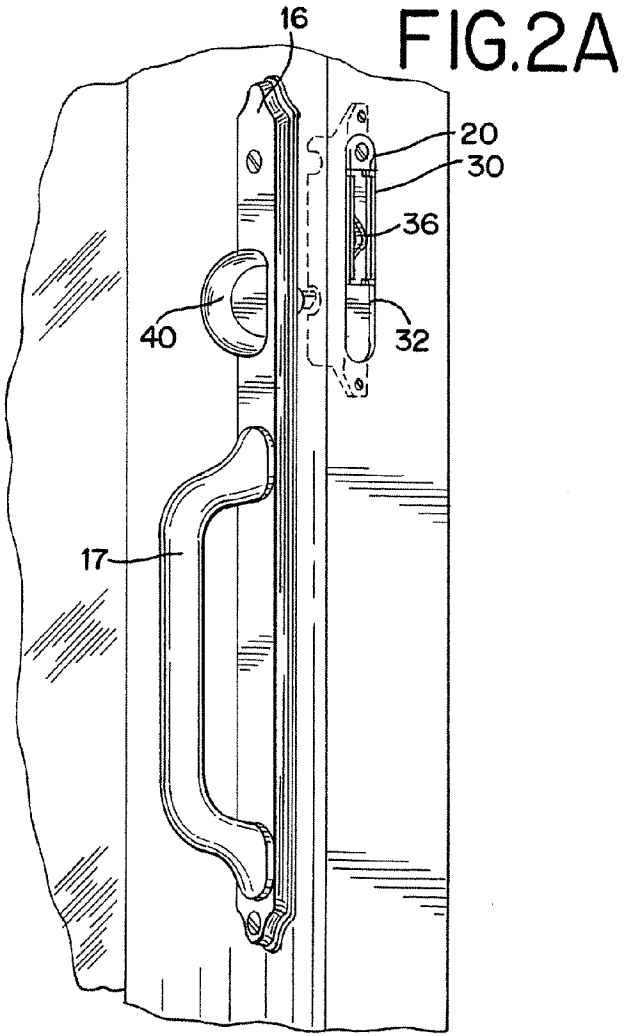
FIG. 2A is a partial perspective view of the door assembly of FIG. 2 showing a lock mechanism of the door assembly.
Figure 1A:
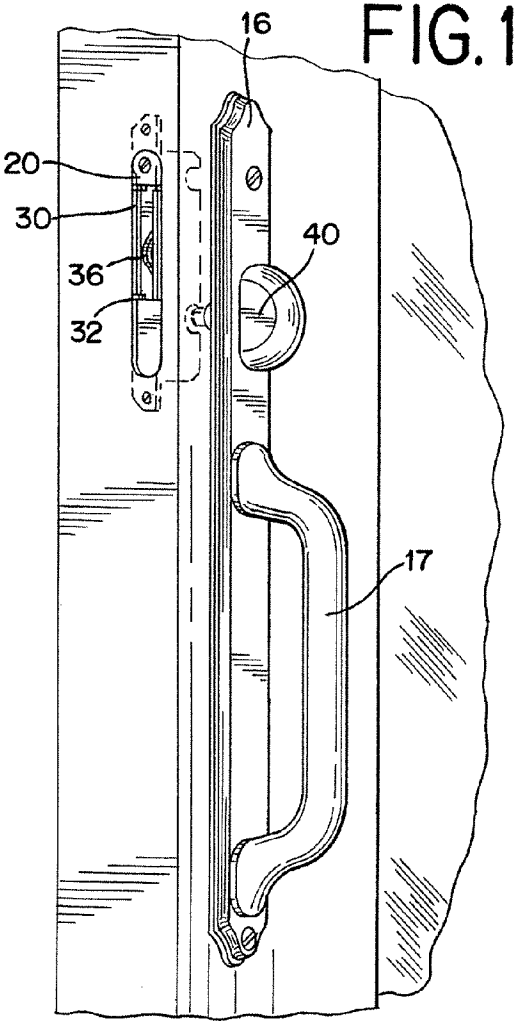
FIG. 1A is a partial perspective view of the door assembly of FIG. 1 showing a lock mechanism of the door assembly.

The lock mechanism 20 is generally shown in FIGS. 1A and 2A. The lock mechanism 20 includes a lock assembly 30 and a handle assembly 40.

As further shown in FIGS. 1 through 2A, the lock assembly 30 includes a housing 32 and a keeper 34. The housing 32 is mounted to the door 14, as shown in FIGS. 1A and 2A. The keeper 34 is mounted on the frame 12, as shown in FIGS. 1 and 2, such that when the door 14 is in the closed position, the keeper 34 is adjacent the housing 32. In an alternate embodiment, the keeper 34 can be integrally formed in the frame 12. The housing 32 includes an internal lock member or hook 36, having a locked position and an unlocked position. The housing 32 also includes a rotating member 33 having an aperture 38 which is operably linked to the hook 36 such that rotation of the aperture 38 actuates the hook 36 between the locked position and the unlocked position. In the unlocked position shown in FIGS. 3 and 4, the hook 36 is substantially contained within the housing 32 permitting the door 14 to be opened. In the locked position shown in FIGS. 3A and 4A, the hook 36 is substantially outboard of the housing 32, and the hook 36 engages the keeper 34 so as to lock the locking assembly 30. In the locked position, the door 14 is locked in the closed position and prevented from opening. The hook 36 has an aperture that is accessible through the housing 32 that will receive a portion of the handle assembly 40 as described in greater detail below.

Figure 5:
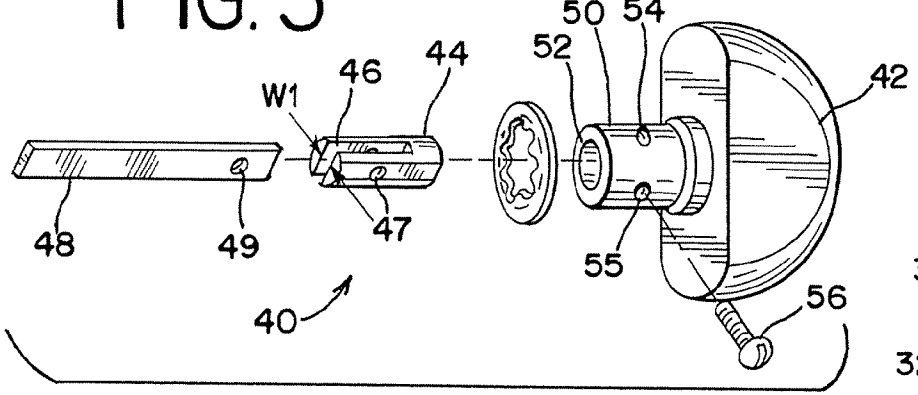
FIG. 5 is a an exploded perspective view of the handle assembly of FIGS. 3 and 4.
Figure 7:
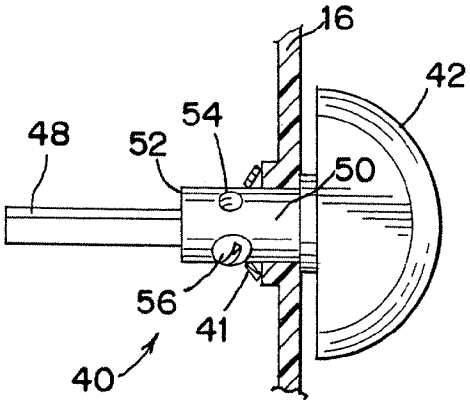
FIG. 7 is a side elevation view of the handle assembly of FIG. 5.
Figure 6:
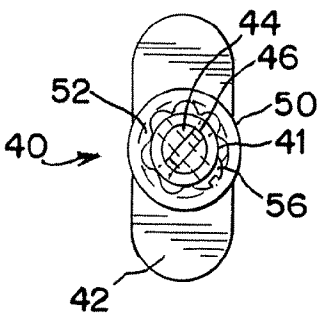
FIG. 6. is an end view of the handle assembly of FIG. 5.

The lock mechanism 20 also includes a handle assembly 40, as shown in FIG. 5. The handle assembly 40 is mated with the lock assembly 30, mounted on the door 14 and retained by a retainer 41. Although the FIGURES show the handle assembly 40 mounted to the door 14 via the escutcheon 16, it is understood that the handle assembly 40 can be mounted in any location on the door 14 which permits the handle assembly 40 to mate with the housing 32 of the lock assembly 30. As shown in FIG. 5, the handle assembly 40 includes a handle 42, and adapter 44, and a tailpin 48. The tailpin, or rotatable member 48, is operably connected to the handle 42 by the adapter 44. The handle 42 includes a stem 50 having a receiver 52 capable of receiving the adapter 44. The stem 50 has two sets of apertures 54, 55 providing access to the receiver 52. The second aperture 55 has an angular position that is rotationally displaced from the first aperture 54 by approximately 90 degrees. The adapter 44 is generally cylindrical in shape and has a slot 46 adapted to receive the tailpin, or member 48, of the handle assembly 40. The slot 46 has a width W1, as seen in FIG. 5. The tailpin 48 is cooperatively dimensioned so as to fit inside the slot 46. The adapter 44 also has an opening 47 providing access to the slot 46. The tailpin 48 includes a tailpin aperture 49.

The handle assembly 40 is assembled by inserting the adapter 44 into the receiver 52 such that the opening 47 in the adapter 44 is aligned with one of the apertures 54, 55 in the stem 50. The selection of the apertures 54, 55 in the stem 50 will depend on the configuration of the handle assembly 40 that is desired. The tailpin 48 is then inserted into the slot 46 of the adapter 44 until the tailpin aperture 49 is aligned with both the opening 47 in the adapter 44 and the selected aperture 54 in the stem 50. The tailpin, or member 48, is retained in the slot 46 of the adapter 44 by a fastener 56 inserted into the corresponding aperture 54 providing access to the receiver 52. Thus the fastener 56 is inserted through the aperture 54 of the stem 50 and through the opening 47 of the adapter 44 and through the tailpin aperture 49, thereby retaining the tailpin 48 in the slot 46 of the adapter 44. In another embodiment, the tailpin 48 has no tailpin aperture 49 and is retained by pressure exerted by the fastener 56 which is inserted through the aperture 54 of the stem 50 and the opening 47 of the adapter 44, thereby retaining the tailpin 48 in the slot 46. Preferably, the fastener 56 is a screw, however other types of fasteners can be used.

As shown in one preferred embodiment, the first and second apertures 54, 55 are offset in opposite directions from a vertical axis. This provides for a tailpin connection that is generally 45 degrees from the vertical axis. This configuration allows the tailpin cooperate with the lock member of the lock assembly. It is understood that other angular configurations are possible. For example, the offset angle can be 30 degrees or 60 degrees, or other angular configurations as desired.

The handle assembly 40 is adjustable in that the tailpin, or member 48, can be repositioned by removing the fastener 56, rotating the adapter 44 and tailpin 48 together, aligning the opening 47 of the adapter 44 with the second set of apertures 55 in the stem 50, and then replacing the fastener 56 into the second aperture 55. First, the tailpin, or member 48, is removed from the slot 46 by removing the fastener 56 from the first aperture 54. Next, the tailpin 48 and adapter 44 together are rotated within the receiver 52 until the opening 47 of the adapter 44 is aligned with the second aperture 55 in the stem 50. Finally, the tailpin 48 and adapter 44 are secured in a similar fashion by inserting the fastener 56 into the second aperture 54, through the opening 47 in the adapter 44, and through the tailpin aperture 49, thereby retaining the tailpin 48 in the slot 46.

Figure 4:
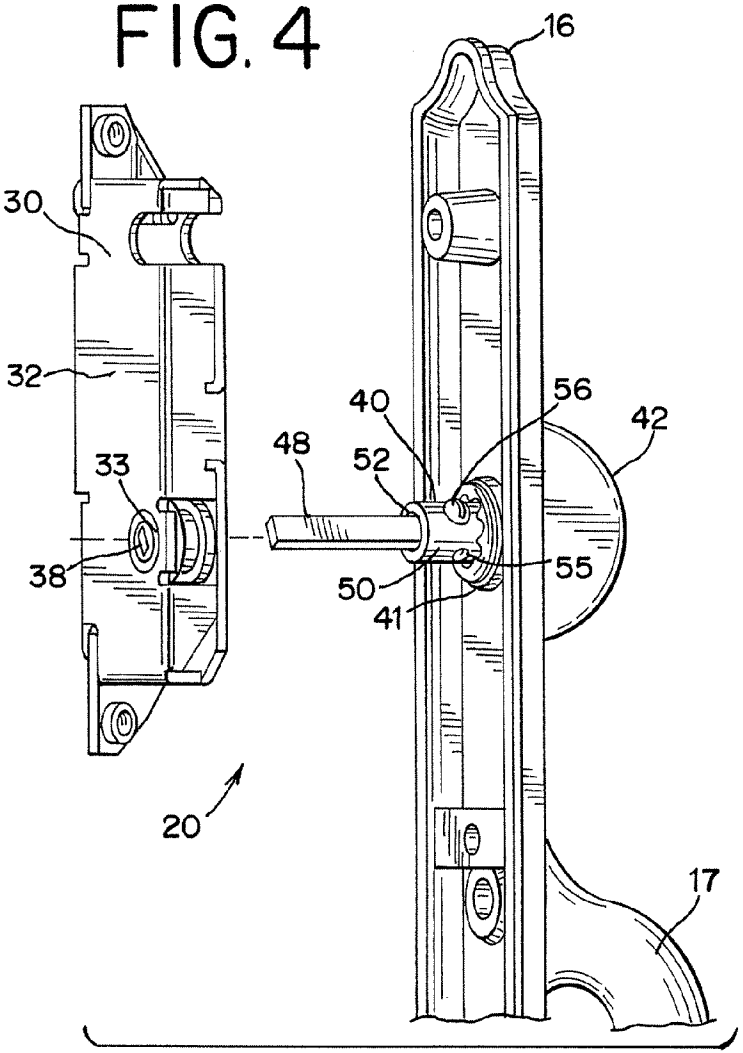
FIG. 4 is a partial exploded perspective view of the lock mechanism for the left hand door assembly of FIG. 2A, showing the lock assembly and handle assembly in the unlocked position.
Figure 3:
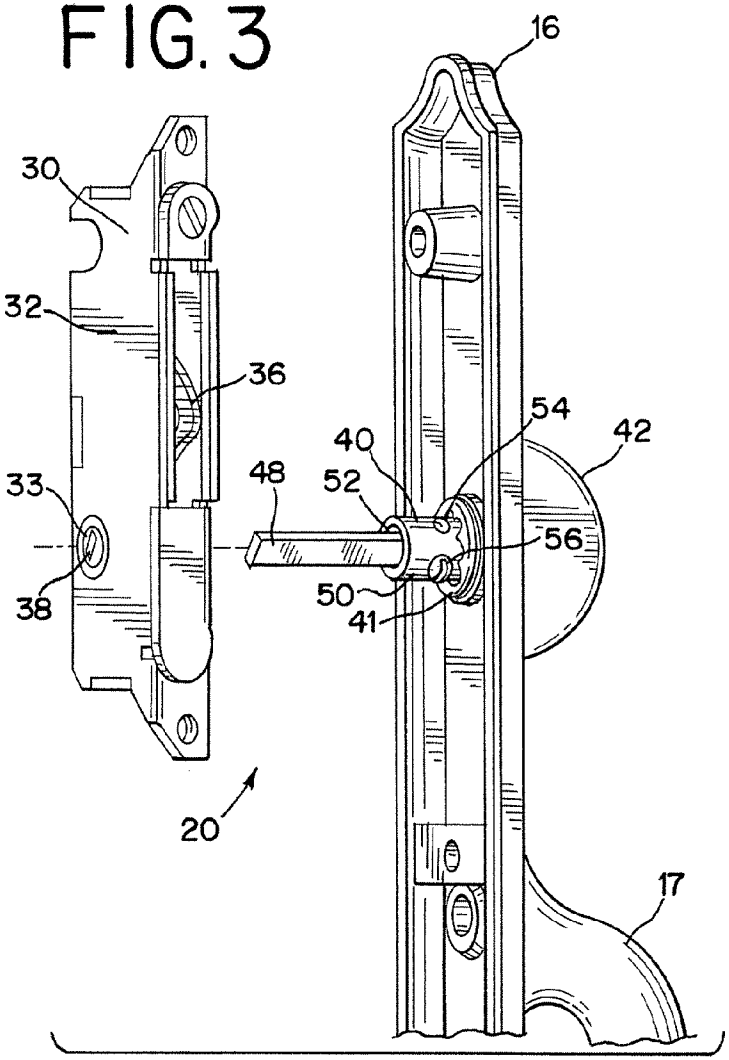
FIG. 3 is a partial exploded perspective view of the lock mechanism for the right hand door assembly of FIG. 1, showing the lock assembly and handle assembly in the unlocked position.

The handle assembly 40 is mounted so as to be operably linked to the lock assembly 30, as shown in FIGS. 3 and 4. The tailpin 48 is inserted into the aperture 38 of the housing 32. The aperture 38 is cooperatively dimensioned so as to receive the tailpin, or member 48, when inserted. Thus, once the tailpin 48 is inserted into the aperture 38 of the housing 32, rotation of the handle 42 actuates the tailpin 48, which in turn actuates the aperture 38, which in turn operates the hook 36 into engagement and disengagement with the keeper 34 thereby locking and unlocking the lock mechanism 20.

The door assembly 10 can be configured to operate with either a right hand door 14, as shown in FIG. 1 or a left hand door 14, as shown in FIG. 2. On the right hand door 14 of FIG. 1, shown in the open position, the door 14 is to the right of the opening 15, which occurs between the frame 12 and the door 14. Thus, the left edge 18 of the door 14 is adjacent the opening 15. Similarly, on the left hand door 14 of FIG. 2, shown in the open position, the door 14 is to the left of the opening 15, which occurs between the frame 12 and the door 14. Thus, the right edge 19 of the door 14 is adjacent the opening 15.

Turning to the left hand door configuration shown in FIGS. 2A and 4, the handle assembly 40 is shown with the handle 42 in the first, or unlocked position. In the unlocked position, the handle 42 is generally vertical. The handle assembly 40 is adjusted such that when the handle 42 is in the first position, and the hook 36 is in the unlocked position, the tailpin 48 can be inserted into the aperture 38 of the housing 32.

Figure 4A:
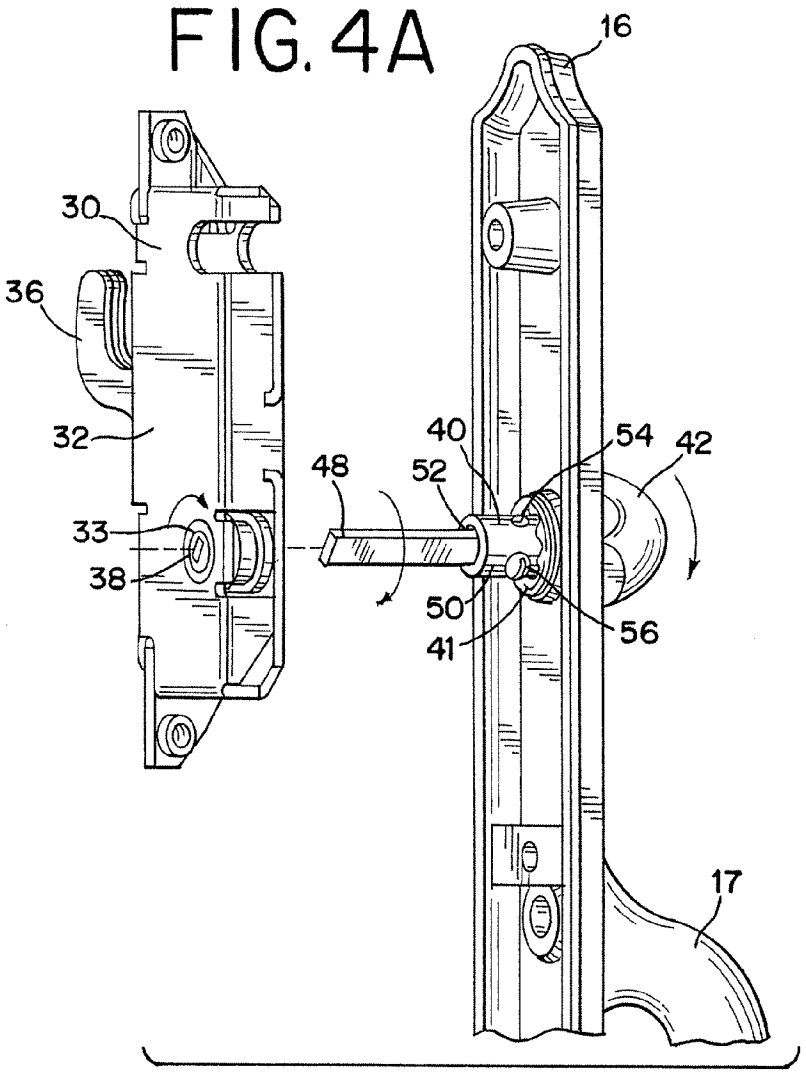
FIG. 4A is a partial exploded perspective view of the lock mechanism of FIG. 4, showing the lock assembly and handle assembly in the locked position.

In FIG. 4, the lock assembly 30 is shown with the hook 36 in the unlocked position, substantially contained within the housing 32. Facing the side of the door 14 from which the handle 42 is visible, when the hook 36 is in the unlocked position, the elongated aperture 38 is in a position approximately 45 degrees clockwise from a vertical axis. Thus, in order for the handle 42 to be vertical in the unlocked position, the tailpin 48 must be 45 degrees clockwise from the vertical axis in order to mate with the aperture 38 when the handle assembly 40 is mounted to the door 14. During operation in the unlocked position, the handle 42 is vertical, while the tailpin 48 and aperture 38 are 45 degrees clockwise from the vertical axis, and the hook 36 is in the unlocked position, or inboard of the housing 32. To lock the lock mechanism 20, the handle 42 is rotated counterclockwise 90 degrees, as shown in FIG. 4A. Rotation of the handle 42 in the counterclockwise direction imparts rotation in the tailpin 48, which in turn rotates the aperture 38 in the counterclockwise direction CCW. Rotation of the aperture 38 of the housing 32 actuates the hook 36 from the unlocked position to the locked position. Thus, rotation of the handle 42 in the counterclockwise direction actuates the lock mechanism 20 causing the hook 36 to engage the keeper 34 mounted on the frame 12.

As shown in FIG. 4A, after the handle 42 is rotated 90 degrees counterclockwise, the handle 42 is in the second or locked position. When the handle 42 is in the locked position, it is generally horizontal. In this position, both the tailpin 48 and aperture 38 in the housing 32 have rotated 90 degrees counterclockwise. Thus, in the locked position, both the tailpin 48 and the aperture 38 are approximately 45 degrees counterclockwise of vertical. With the handle 42 in the second, or locked position, the hook 36 is in the locked position substantially outboard of the housing 32. The hook 36 engages the keeper 34 when it is in the locked position, thereby locking the lock mechanism 20 and preventing the door 14 from being opened. It is understood that the device may be configured wherein the handle 42 can be rotatable between the unlocked and locked position at angular rotations other than 90 degrees.

Similarly, the lock mechanism can be installed in a right hand door, as shown in FIGS. 1A and 3. Turning to the right hand door configuration shown in FIGS. 1A and 3, the handle assembly 40 is shown with the handle 42 in the first, or unlocked position. In the unlocked position, the handle 42 is generally vertical. The handle assembly 40 is adjusted such that when the handle 42 is in the first position, and the hook 36 is in the unlocked position, the tailpin 48 can be inserted into the aperture 38 of the housing 32.

Figure 3A:
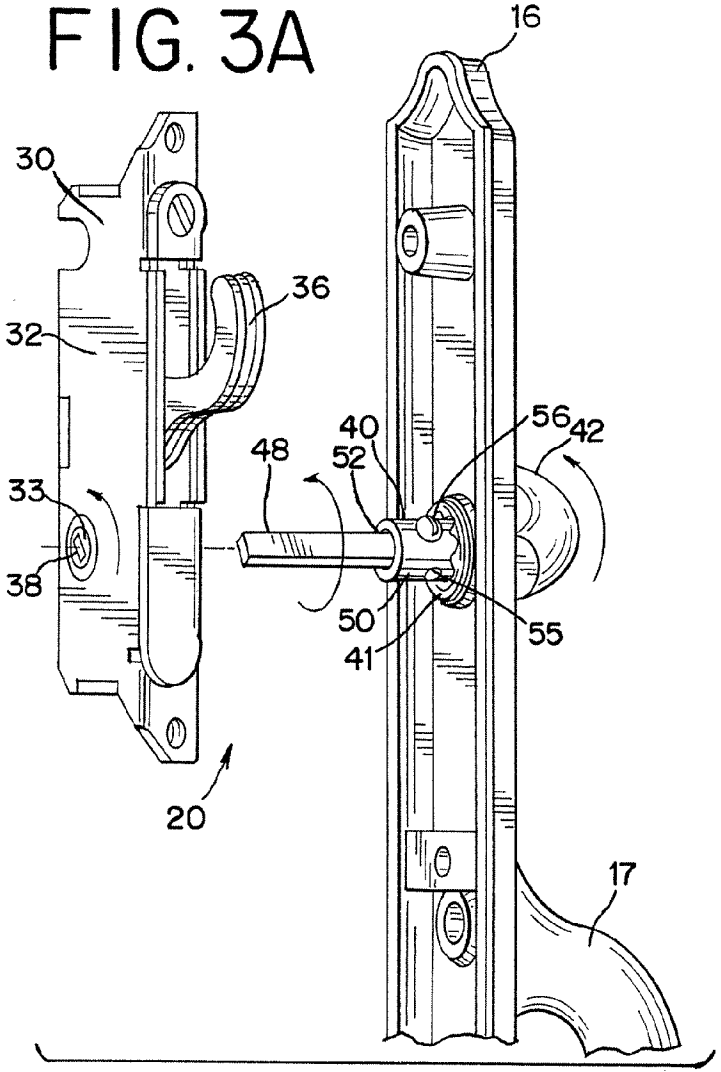
FIG. 3A is a partial exploded perspective view of the lock mechanism of FIG. 3, showing the lock assembly and handle assembly in the locked position.

In FIG. 3, the lock assembly 30 is shown with the hook 36 in the unlocked position, substantially contained within the housing 32. Facing the side of door 14 from which the handle 42 is visible, when the hook 36 is in the unlocked position, the elongated aperture 38 is in a position approximately 45 degrees counterclockwise from a vertical axis. Thus, in order for the handle 42 to be vertical in the unlocked position, the tailpin 48 must be 45 degrees counterclockwise from the vertical axis in order to mate with the aperture 38 when the handle assembly 40 is mounted to the door 14. During operation in the unlocked position, the handle 42 is vertical, while the tailpin 48 and aperture 38 are 45 degrees counterclockwise from the vertical axis, and the hook 36 is in the unlocked position, or inboard of the housing 32. To lock the lock mechanism 20, the handle 42 is rotated clockwise CW 90 degrees, as shown in FIG. 3A. Rotation of the handle 42 in the clockwise direction imparts rotation in the tailpin 48, which in turn rotates the aperture 38 in the clockwise direction. Rotation of the aperture 38 of the housing 32 actuates the hook 36 from the unlocked position to the locked position. Thus, rotation of the handle 42 in the clockwise direction actuates the lock mechanism 20 causing the hook 36 to engage the keeper 34 mounted on the frame 12.

As shown in FIG. 3A, after the handle 42 is rotated 90 degrees clockwise, the handle 42 is in the second or locked position. When the handle 42 is in the locked position, it is generally horizontal. In this position, both the tailpin 48 and aperture 38 in the housing 32 have rotated 90 degrees clockwise. Thus, in the locked position, both the tailpin 48 and the aperture 38 are approximately 45 degrees clockwise of vertical. With the handle 42 in the second, or locked position, the hook 36 is in the locked position substantially outboard of the housing 32. The hook 36 engages the keeper 34 when it is in the locked position, thereby locking the lock mechanism 20 and preventing the door 14 from being opened.

As is clear from the FIGURES, if the handle assembly 40 from a left hand door (FIG. 4) were removed and installed into the lock assembly 30 of a right hand door (FIG. 3), without any adjustment to the handle assembly 40, the handle 42 in the right hand door would not be vertical when the hook 36 was in the unlocked position. Rather, the handle 42 would be horizontal. This is considered an undesirable configuration.

However, the adjustability of the handle assembly 40 of the present invention prevents this undesirable configuration. When the handle assembly 40 is removed from the left hand door (FIG. 4), the tailpin 48 is 45 degrees clockwise of the handle 42. The handle assembly 40 is adjustable by removing the fastener 56 from the aperture 55 in the stem 50, rotating the tailpin 48 and the adapter 44 until the tailpin aperture 49 and the opening 47 in the adapter 44 were aligned with the second aperture 54 in the stem 50, and inserting the fastener 56 through the second aperture 54 in the stem, the opening 47 in the adapter 44 and the tailpin aperture 49. This adjustment to the handle assembly 40 results in the tailpin 48 being rotated 90 degrees counterclockwise of its original position. Thus, after adjustment, the tailpin 48 is now 45 degrees counterclockwise of the handle, as is shown in FIG. 3. Therefore, following the adjustment, the handle assembly 40 can be installed in a right hand door, as shown in FIG. 3. When installed in the right hand door, the handle 42 is vertical in the first, or unlocked position, while the tailpin 48 is 45 degrees counterclockwise of vertical, allowing the tailpin 48 to mate with the aperture 38 in the housing 32, while the hook 36 is in the unlocked position or substantially within the housing 32.

Similarly, the handle assembly 40 of a right hand door (FIG. 3) can be removed, adjusted and installed in a left hand door (FIG. 4). When the handle assembly 40 is removed from the right hand door (FIG. 3), the tailpin 48 is 45 degrees counterclockwise of the handle 42. The handle assembly 40 could be adjusted by removing the fastener 56 from the aperture 54 in the stem 50, rotating the tailpin 48 and the adapter 44 until the tailpin aperture 49 and the opening 47 in the adapter 44 were aligned with the second aperture 54 in the stem 50, and inserting the fastener 56 through the second aperture 54 in the stem, the opening 47 in the adapter 44 and the tailpin aperture 49. This adjustment to the handle assembly 40 results in the tailpin 48 being rotated 90 degrees clockwise of its original position. Thus, after adjustment, the tailpin 48 is now 45 degrees clockwise of the handle, as is shown in FIG. 4. Therefore, following the adjustment, the handle assembly 40 can be installed in a right hand door, as shown in FIG. 4. When installed in the right hand door, the handle 42 is vertical in the first, or unlocked position, while the tailpin 48 is 45 degrees clockwise of vertical, allowing the tailpin 48 to mate with the aperture 38 in the housing 32, will while the hook 36 is in the unlocked position or substantially within the housing 32. Thus, due to the adjustable configuration as described above, the identical handle assembly 40 can be installed on either a right hand door or left hand door eliminating the need for separate handle assemblies 40.

Although the handle 42 is depicted in the FIGURES to be a thumbturn, it is understood that the handle 42 can take many other forms. The handle 42 may be a lever, a knob, a button, or any combination thereof without departing from the spirit of the invention, provided that the handle 42 permits the operator to actuate the tailpin 48.

Figure 8:
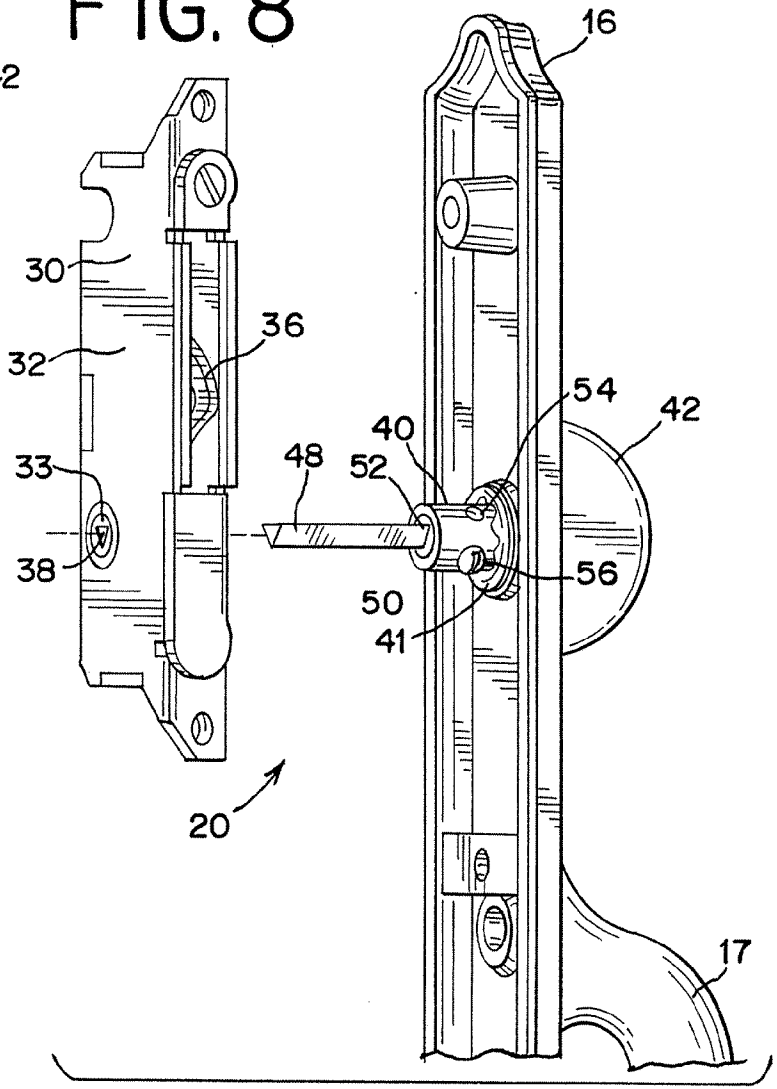
FIG. 8 is a partial exploded perspective view of the lock mechanism of FIG. 4, showing an alternate embodiment where a tailpin of the handle assembly has a triangular cross-section.

It is also understood that the tailpin, or member 48, can take forms having a multitude of various cross-sections, including, but not limited to, circular, square, oval, triangular, and hexagonal. However, as shown in FIG. 8, the tailpin 48 and the aperture 38 in the housing 32 must be cooperatively dimensioned such that when the tailpin 48 is inserted into the aperture 38, actuation or rotation of the tailpin 48 will impart rotation on the aperture 38 of the housing 32.

Furthermore, although in the FIGURES the tailpin, or member 48 is retained in the adapter 44, and the adapter 44 is retained in the receiver 52 of the handle 42 with a fastener 56 passed through an aperture 54 in the stem 50 of the handle 42, it is understood that other retaining means could be employed. For example, the tailpin 48 can have sides which are textured or splined to create a friction fit between the tailpin 48 and the adapter 44. Likewise, the adapter 44 could have a similar textured or splined exterior creating a friction fit between the adapter 44 and the receiver 52 of the handle 42. Other potential retaining mechanisms include keys, grooves, springs, threads, or clamps.

It is also understood that while the door assembly 10 shown in FIGS. 1–2 operates by sliding the door 14 between an open and closed position, the door assembly 10 may take other forms, without departing from the spirit of the invention. For example, the door assembly 10 can include a traditional swinging door 14 pivotally mounted in the frame 12, as is well known in the art. The door 14 can be pivoted from a closed position, where the door 14 is flush with the frame 12, to an open position, with the door 14 at least partially outboard from the frame 12. Such a pivoting door assembly 10 can be configured with either a left hand door 14 or a right hand door 14. When facing a left hand door 14, the door 14 is pivotally mounted to the frame along the left edge 18 of the door, while the lock assembly 30 is mounted adjacent the right edge 19 of the door 14. Likewise, when facing a right hand door 14, the door 14 is pivotally mounted to the frame along the right edge 19 of the door, while the handle assembly 40 is mounted adjacent the left edge 18 of the door 14.

However, regardless of whether the door assembly 10 is configured with a left hand door 14 or a right hand door 14, the door 14 must be in the closed position when the door 14 is flush with the frame 12 and the lock assembly 30 is adjacent the keeper 34 mounted on the frame 14. Thus, when the door 14 is in the closed position, the lock mechanism 20 can be actuated such that the hook 36 of the lock assembly 30 engages the keeper 34, thereby locking the lock mechanism 20 and securing the door 14 in the locked position. Therefore, regardless of the manner of operation of the door between the open position and closed position, the lock mechanism 20 of the present invention may be employed to secure the door 14 in the closed position.

FIGS. 9–12 show an alternate embodiment of the lock mechanism 20 of the present invention. In this particular embodiment, structures of the handle assembly 40 are modified such that the same handle assembly 40 can be used with multiple lock assemblies 30. For example, in one preferred embodiment, the handle assembly 40 will function with a lock assembly 30*a* (FIG. 9) having an aperture positioned at a first angular position A1 and also with a different lock assembly 30*b*(FIG. 10) having an aperture positioned at a second angular position A2.

Figure 10:
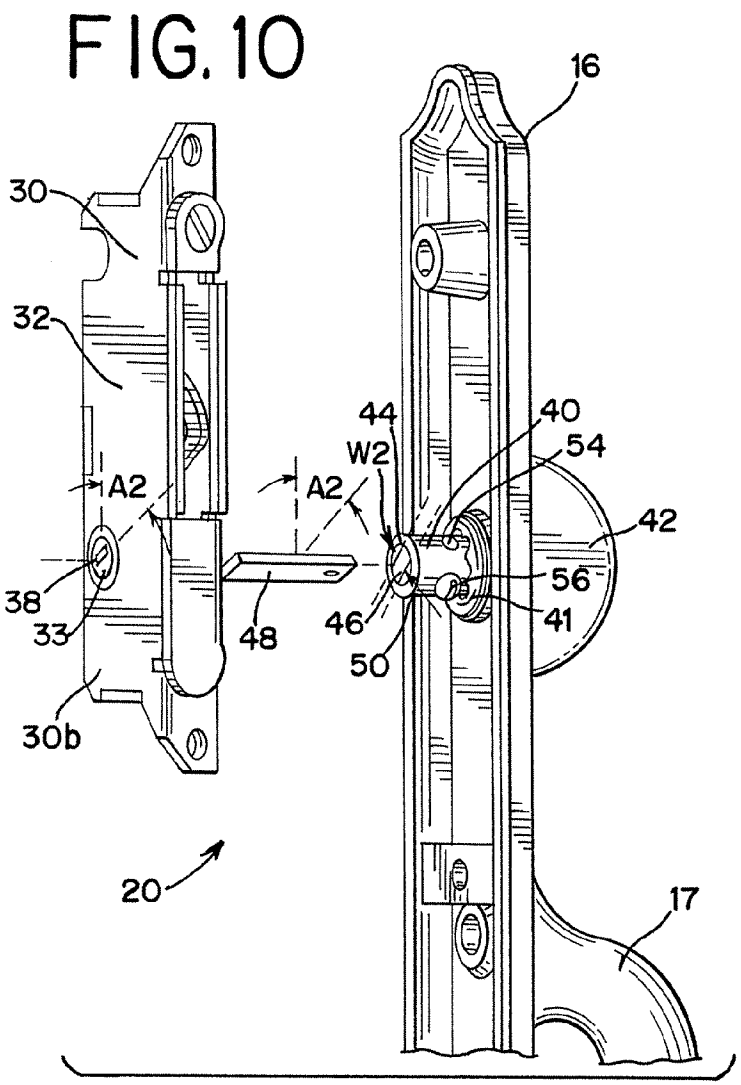
FIG. 10 is a partial exploded perspective view of a similar lock mechanism shown in FIG. 9 showing a tailpin of the handle assembly in a second angular position to cooperate with a second locking assembly.
Figure 9:
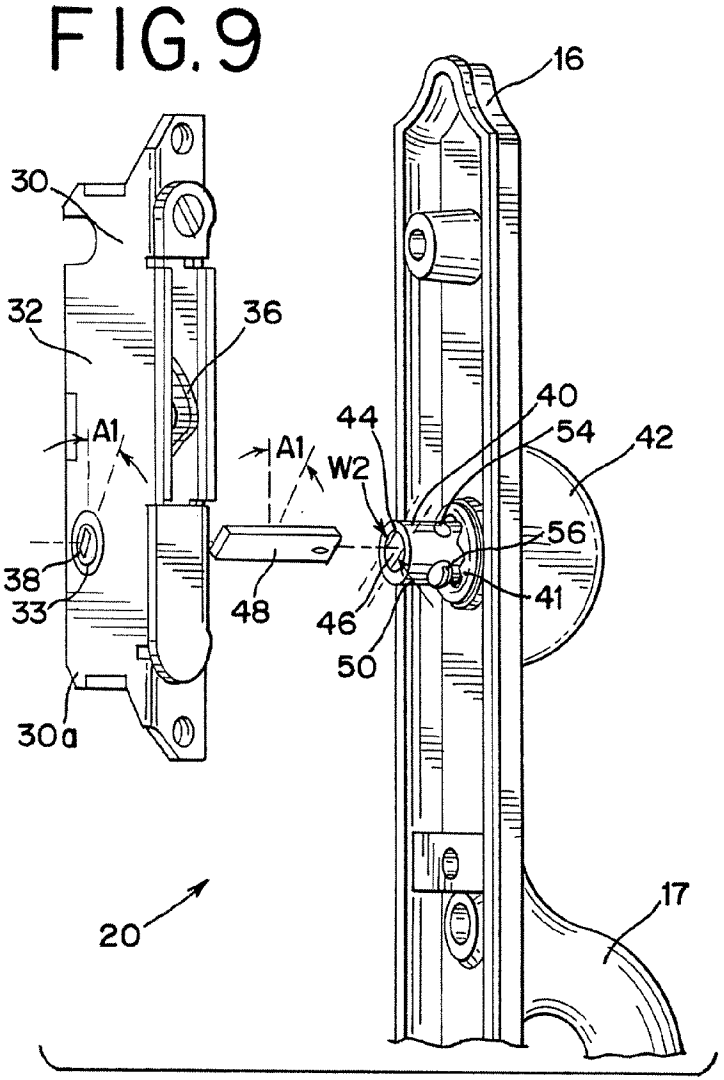
FIG. 9 is a partial exploded perspective view of a lock mechanism having an alternate embodiment of a handle assembly having a tailpin in a first angular position.
Figure 12:
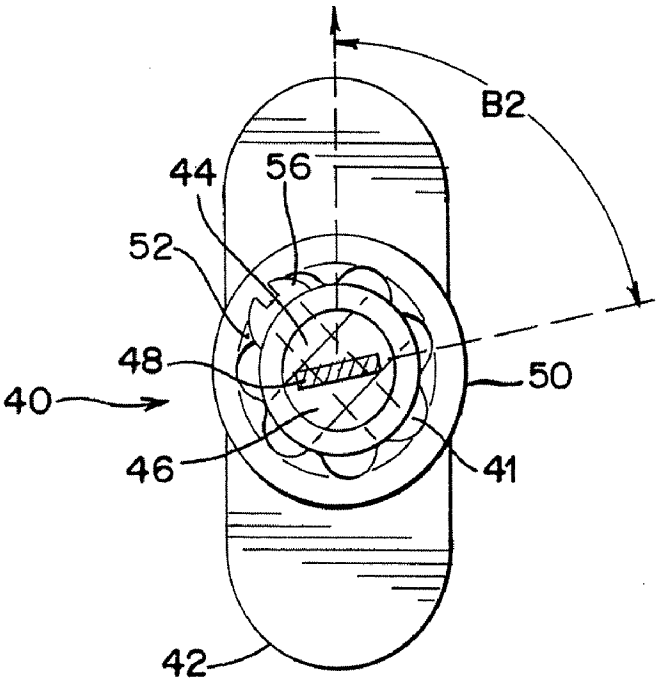
FIG. 12 is a schematic end-view of the handle assembly of FIG. 10 with the tailpin in the second angular position.
Figure 11:
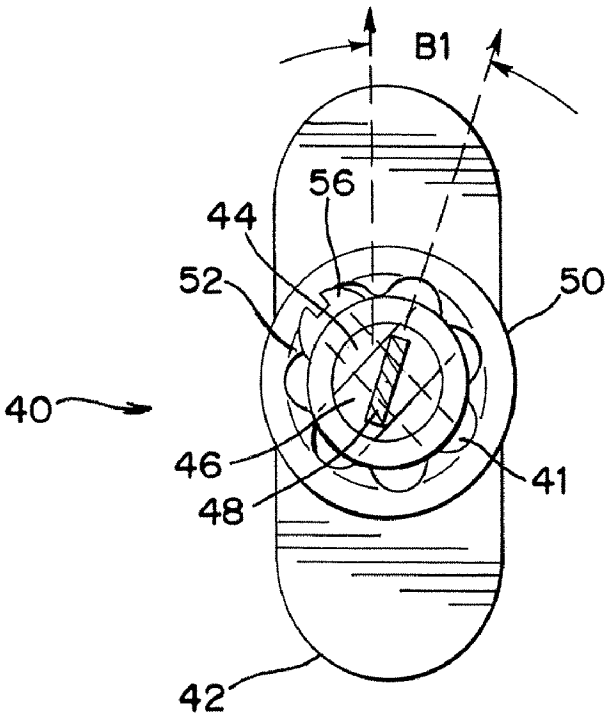
FIG. 11 is a schematic end-view of the handle assembly of FIG. 9 with the tailpin in the first angular position.

As further shown in FIGS. 9–12, the slot 46 of the adapter 44 of the handle assembly 40 has a width W2. The width W2 is wider than the width W1 of the slot 46 shown in FIG. 5. With the greater width W2 of the slot 46, the tailpin 48 is capable of greater angular movement within the slot 46. Like the first preferred embodiment, the handle assembly 40 of this alternate embodiment includes a handle 42 and the adapter 44. The slot 46 of the adapter 44 receives the tailpin 48. The tailpin 48 is then inserted into the aperture 38 of the locking assembly 30 to connect the handle assembly 40 to the lock assembly 30. Importantly, because the width W2 of the slot 46 is larger than the width of the tailpin 48, the tailpin 48 is permitted to deviate in an angular fashion, or "wiggle," within the slot 46, without causing angular displacement of the handle 42. Therefore, the tailpin 48 is adjustable within the adapter 44 from a first angular position B1 (FIG. 11) to a second angular position B2 (FIG. 12). It is understood that FIGS. 11 and 12 are schematic figures such that the "play" or movement of the tailpin 48 may be slightly exaggerated for illustration. Thus, as can be seen in FIGS. 9–12, the handle 42 can then remain in a single angular position while the tailpin 48 is placed in the wider slot 46 in a multitude of angular positions. In this way, the handle 42 can be used with a variety of locking assemblies 30. For example, in FIG. 9, with the handle 42 in the unlocked position, the tailpin 48 is in a first angular position allowing it to mate with the aperture 38 of a first locking assembly 30*a*. The first locking assembly 30*a*, shown in the unlocked position in FIG. 9, has an aperture 38 in a first angular position A1. In one preferred embodiment, the first angular position A1 may be 30 degrees. Referring now to FIG. 10, the same handle 42 is shown in the unlocked position. The tailpin 48, however, is in a second position rotated from the position shown in FIG. 9. In this position, the tailpin 48 can mate with the aperture 38 of a second locking mechanism 30*b*. The second locking assembly 30*b*, shown in the unlocked position in FIG. 10, has an aperture 38 in a second angular position A2. In one preferred embodiment, the second angular position A2 may be 45 degrees. Thus, the adjustability of the tailpin 48 within the width W2 of the slot 46, allows the tailpin 48 and handle assembly 42 to be connected to a variety of different lock assemblies 30*a*,30*b*. It is understood that while locking assemblies 30*a*,30*b* are shown having apertures at 30 degrees and 45 degrees, other locking assemblies having apertures at other angular configurations are also possible.

Although the tailpin 48 is shown as being connected to the locking assembly 30 through mating of the tailpin 48 with the aperture 38 in the rotating member 33, it is understood that the tailpin 48 can be connected to the locking assembly 30 in a variety of different manners well known in the art. Furthermore, it is understood that the tailpin 48 may be integrally formed with the rotating member 33 of the locking assembly 30, such that the aperture 38 is unnecessary.

While the specific embodiments and various details thereof have been illustrated and described, numerous modifications come to mind without significantly departing from the spirit of the invention and the scope of protection is only limited by the following claims.

We claim:

1. A device for operating a lock assembly, the lock assembly having a first configuration when mounted in a right hand door and a second configuration when mounted in a left hand door, the device comprising:

a member having a first angular position in the first configuration and a second angular position in the second configuration, the second position being at a different angle from the first position, wherein the member has structure adapted to cooperate with the lock assembly;

a handle having a first position representing an unlocked position and a second position representing a locked position; and an adapter connected to the member, the adapter further being adjustably connected to the handle, such that the first position of the handle when the member is in the first position is the same as the first position of the handle when the member is in the second position wherein the handle has a first aperture and a second aperture, the adapter being adjustably connected to the handle by a fastener positioned in the first aperture to define the member first position, and the adapter being adjustably connected to the handle by the fastener positioned in the second aperture to define the member second position.

2. The device of claim 1 wherein the second position of the handle when the member is in the first position is the same as the second position of the handle when the member is in the second position.

3. The device of claim 1 wherein the handle first position represents an unlocked position and the handle second position represents a handle locked position.

4. The device of claim 3 wherein in the unlocked position, the handle has a generally vertical configuration.

5. The device of claim 1 wherein in the locked position, the handle has a generally horizontal configuration.

6. The device of claim 1 wherein in the member first position, the member structure is adapted to cooperate with the lock assembly configured for a right hand door.

7. The device of claim 1 wherein in the member second position, the member structure is adapted to cooperate with the lock assembly configured for a left hand door.

8. The device of claim 1 wherein the second position of the handle is rotationally displaced from the first position of the handle.

9. The device of claim 8 wherein the second position of the handle is rotationally displaced 90 degrees from the first position of the handle.

10. The device of claim 8 wherein the second position of the handle is rotationally displaced less than 90 degrees from the first position of the handle.

11. The device of claim 1 wherein the member first position is offset from a vertical axis.

12. The device of claim 11 wherein the member second position is offset from a vertical axis in a direction opposite the member first position.

13. The device of claim 11 wherein the member first position is offset generally 45 degrees from the vertical axis.

14. The device of claim 11 wherein the member first position is offset generally 30 degrees from the vertical axis.

15. The device of claim 12 wherein the member second position is offset generally 45 degrees from the vertical axis.

16. The device of claim 12 wherein the member second position is offset generally 30 degrees from the vertical axis.

17. The device of claim 1 wherein the member has a generally rectangular cross-section adapted to cooperate with an aperture of a lock member of the lock assembly.

18. The device of claim 1 wherein the handle is a thumbturn.

19. A device for operating a lock assembly, the lock assembly having a first configuration when mounted in a right hand door and a second configuration when mounted in a left hand door, the device comprising:

a member having a first angular position in the first configuration and a second angular position in the second configuration, the second position being at a different angle from the first position, wherein the member is cooperatively dimensioned and adapted to engage the lock assembly;

a handle having a first position representing an unlocked position and a second position representing a locked position; and, an adapter connected to the member, the adapter further being adjustably connected to the handle, such that the first position of the handle when the member is in the first position is the same as the first position of the handle when the member is in the second position wherein the handle has a first aperture and a second aperture, the adapter being adjustably connected to the handle by a fastener positioned in the first aperture to define the member first position, and the adapter being adjustably connected to the handle by the fastener positioned in the second aperture to define the member second position.

20. The device of claim 19 wherein the cross-section of the member is a quadrilateral.

21. The device of claim 19 wherein the cross-section of the member is a rectangle.

22. The device of claim 19 wherein the adapter further has a slot adapted to receive the member.

23. The device of claim 22 wherein the fastener is adapted to retain the member in the slot.

24. The device of claim 23 wherein the fastener is a screw.

* * * * *